US009981477B2

(12) United States Patent
Fukuchi et al.

(10) Patent No.: US 9,981,477 B2
(45) Date of Patent: May 29, 2018

(54) LIQUID EJECTING DEVICE AND HEAD

(71) Applicant: CANON KABUSHIKI KAISHA, Tokyo (JP)

(72) Inventors: Hironori Fukuchi, Kawasaki (JP); Keisuke Iinuma, Yokohama (JP); Tatsuo Nanjo, Kawasaki (JP); Keiichiro Tsukuda, Yokohama (JP); Yasuo Kotaki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/294,406

(22) Filed: Oct. 14, 2016

(65) Prior Publication Data

US 2017/0120612 A1 May 4, 2017

(30) Foreign Application Priority Data

Oct. 30, 2015 (JP) ..... 2015-214223

(51) Int. Cl.
*B41J 2/175* (2006.01)
*B41J 29/02* (2006.01)

(52) U.S. Cl.
CPC ..... *B41J 2/17553* (2013.01); *B41J 2/175* (2013.01); *B41J 2/1752* (2013.01); (Continued)

(58) Field of Classification Search
CPC .... B41J 2/17553; B41J 29/02; B41J 2/17556; B41J 2/17513; B41J 2/175; B41J 2/1752
See application file for complete search history.

(56) References Cited

U.S. PATENT DOCUMENTS 5,425,478 A 6/1995 Kotaki et al. ..... 222/501
5,430,471 A 7/1995 Nakajima et al. ..... 347/87
(Continued)

FOREIGN PATENT DOCUMENTS

EP 1057644 12/2000
JP 2000-246911 9/2000
JP 2007-105883 4/2007

OTHER PUBLICATIONS

Extended European Search Report dated Mar. 1, 2017, in counterpart European Application No. 16002141.6.
(Continued)

*Primary Examiner* — Henok Legesse
(74) *Attorney, Agent, or Firm* — Fitzpatrick, Cella, Harper & Scinto

(57) ABSTRACT

There are provided a liquid ejecting device that can efficiently supply liquid inside a liquid containing unit with a simple structure and the liquid containing unit. The present invention is the liquid ejecting device which includes a liquid container, a head that is provided on a carriage and has a liquid containing unit capable of storing liquid thereinside and a liquid ejecting unit, and a flexible member that connects the liquid container to the liquid containing unit and supplies the liquid stored inside the liquid container to the liquid containing unit. A holding member is arranged inside the liquid containing unit to hold the liquid, and the shortest distance between a supply port opened to an inside of the liquid containing unit and the holding member is 0.1 mm or more and 5.0 mm or less.

19 Claims, 7 Drawing Sheets

(52) U.S. Cl.
CPC ..... *B41J 2/17513* (2013.01); *B41J 2/17556* (2013.01); *B41J 29/02* (2013.01)

(56) References Cited

U.S. PATENT DOCUMENTS

| | | | | |
|---|---|---|---|---|
| 5,504,511 | A | 4/1996 | Nakajima et al. | 347/86 |
| 5,567,373 | A | 10/1996 | Sato et al. | 264/112 |
| 5,583,549 | A | 12/1996 | Ujita et al. | 347/86 |
| 5,589,862 | A | 12/1996 | Ujita et al. | 347/87 |
| 5,604,523 | A | 2/1997 | Tsukuda et al. | 347/86 |
| 5,608,437 | A | 3/1997 | Iwata et al. | 347/86 |
| 5,619,237 | A | 4/1997 | Inoue et al. | 347/86 |
| 5,619,239 | A | 4/1997 | Kotaki et al. | 347/86 |
| 5,621,446 | A * | 4/1997 | Tanaka | B41J 2/17506 347/85 |
| 5,742,310 | A | 4/1998 | Kotaki | 347/86 |
| 5,751,300 | A | 5/1998 | Cowger et al. | 347/6 |
| 5,781,213 | A | 7/1998 | Ujita et al. | 347/86 |
| 5,784,088 | A | 7/1998 | Ujita et al. | 347/86 |
| 5,805,188 | A | 9/1998 | Nakajima et al. | 347/87 |
| 5,815,184 | A | 9/1998 | Ujita et al. | 347/87 |
| 5,852,457 | A | 12/1998 | Kotaki et al. | 347/86 |
| 5,900,889 | A | 5/1999 | Tsukuda | 347/23 |
| 5,929,885 | A | 7/1999 | Nakajima et al. | 347/87 |
| 5,988,804 | A | 11/1999 | Kotaki et al. | 347/87 |
| 6,070,974 | A | 6/2000 | Kotaki et al. | 347/86 |
| 6,102,533 | A | 8/2000 | Nozawa et al. | 347/86 |
| 6,116,722 | A | 9/2000 | Sato et al. | 347/85 |
| 6,145,975 | A | 11/2000 | Kotaki et al. | 347/87 |
| 6,152,555 | A | 11/2000 | Nozawa et al. | 347/49 |
| 6,170,939 | B1 | 1/2001 | Ujita et al. | 347/86 |
| 6,234,615 | B1 | 5/2001 | Tsukuda | 347/85 |
| 6,243,116 | B1 | 6/2001 | Kotaki et al. | 347/86 |
| 6,264,315 | B1 | 7/2001 | Nozawa et al. | 347/86 |
| 6,336,709 | B1 | 1/2002 | Inoue et al. | 347/49 |
| 6,338,546 | B1 | 1/2002 | Kotaki et al. | 347/49 |
| 6,361,158 | B1 | 3/2002 | Inoue et al. | 347/86 |
| 6,390,612 | B1 | 5/2002 | Kotaki et al. | 347/85 |
| 6,402,298 | B1 | 6/2002 | Nanjo et al. | 347/49 |
| 6,409,322 | B1 * | 6/2002 | Ishitsu | B41J 2/175 347/85 |
| 6,419,350 | B1 | 7/2002 | Abe et al. | 347/86 |
| 6,421,623 | B1 | 7/2002 | Furukawa et al. | 702/100 |
| 6,454,399 | B2 | 9/2002 | Ujita et al. | 347/86 |
| 6,565,199 | B2 | 5/2003 | Ujita et al. | 347/86 |
| 6,623,104 | B1 | 9/2003 | Kotaki et al. | 347/49 |
| 6,702,427 | B2 | 3/2004 | Shimizu et al. | 347/50 |
| 6,712,458 | B2 | 3/2004 | Hatasa et al. | 347/86 |
| 6,719,416 | B2 | 4/2004 | Anma et al. | 347/86 |
| 6,742,881 | B2 | 6/2004 | Kotaki et al. | 347/86 |
| 6,783,220 | B2 | 8/2004 | Ujita et al. | 347/87 |
| 6,815,381 | B1 | 11/2004 | Yamamoto et al. | 442/187 |
| 6,824,258 | B2 | 11/2004 | Yamamoto et al. | 347/86 |
| 6,827,431 | B2 | 12/2004 | Kitabatake et al. | 347/86 |
| 6,869,158 | B2 | 3/2005 | Kojima et al. | 347/19 |
| 6,877,846 | B2 | 4/2005 | Fellingham et al. | 347/85 |
| 6,877,847 | B2 | 4/2005 | Hayashi et al. | 347/86 |
| 6,916,085 | B2 | 7/2005 | Kotaki et al. | 347/49 |
| 6,942,325 | B2 | 9/2005 | Nanjo | 347/86 |
| 6,942,326 | B2 | 9/2005 | Hayashi et al. | 347/86 |
| 6,966,631 | B2 | 11/2005 | Matsuo et al. | 347/49 |
| 6,971,741 | B2 | 12/2005 | Nanjo et al. | 347/85 |
| 7,077,514 | B2 | 7/2006 | Inoue et al. | 347/86 |
| 7,104,640 | B2 | 9/2006 | Ogura et al. | 347/86 |
| 7,111,931 | B2 | 9/2006 | Amma et al. | 347/86 |
| 7,118,194 | B2 | 10/2006 | Matsuo et al. | 347/49 |
| 7,125,109 | B2 | 10/2006 | Watanabe et al. | 347/86 |
| 7,134,747 | B2 | 11/2006 | Hayashi et al. | 347/86 |
| 7,165,829 | B2 | 1/2007 | Hayashi et al. | 347/49 |
| 7,207,159 | B2 | 4/2007 | Nanjo et al. | 53/492 |
| 7,293,865 | B2 | 11/2007 | Tsukuda et al. | 347/86 |
| 7,303,090 | B2 | 12/2007 | Nanjo et al. | 220/360 |
| 7,350,910 | B2 | 4/2008 | Amma et al. | 347/86 |
| 7,384,116 | B2 | 6/2008 | Kotaki et al. | 347/19 |
| 7,384,129 | B2 | 6/2008 | Nagata et al. | 347/43 |
| 7,396,118 | B2 | 7/2008 | Ogawa et al. | 347/87 |
| 7,401,909 | B2 | 7/2008 | Inoue et al. | 347/86 |
| 7,407,274 | B2 | 8/2008 | Inoue et al. | 347/86 |
| 7,407,275 | B2 | 8/2008 | Inoue et al. | 347/86 |
| 7,552,837 | B2 | 6/2009 | Nanjo et al. | 220/360 |
| 7,735,984 | B2 | 6/2010 | Iijima et al. | 347/86 |
| 7,914,137 | B2 | 3/2011 | Inoue et al. | 347/86 |
| 7,926,927 | B2 | 4/2011 | Kotaki et al. | 347/86 |
| 7,950,790 | B2 | 5/2011 | Kubo et al. | 347/86 |
| 8,020,978 | B2 | 9/2011 | Ogawa et al. | 347/86 |
| 8,047,641 | B2 | 11/2011 | Nanjo et al. | 347/86 |
| 8,109,617 | B2 | 2/2012 | Kotaki et al. | 347/86 |
| 8,136,930 | B2 | 3/2012 | Anma et al. | 347/86 |
| 8,205,974 | B2 | 6/2012 | Ogura et al. | 347/86 |
| 8,313,185 | B2 | 11/2012 | Hatasa et al. | 347/92 |
| 8,322,807 | B2 | 12/2012 | Seki et al. | 347/6 |
| 8,425,022 | B2 | 4/2013 | Inoue et al. | 347/86 |
| 8,469,498 | B2 | 6/2013 | Ohashi et al. | 347/86 |
| 8,529,037 | B2 | 9/2013 | Miyashita et al. | 347/86 |
| 8,550,607 | B2 | 10/2013 | Inoue et al. | 347/86 |
| 8,770,730 | B2 | 7/2014 | Nanjo et al. | 347/86 |
| 8,770,731 | B2 | 7/2014 | Miyashita et al. | 347/86 |
| 8,960,869 | B2 | 2/2015 | Takada et al. | 347/86 |
| 9,016,842 | B2 | 4/2015 | Miyashita et al. | 347/86 |
| 9,333,758 | B2 | 5/2016 | Koshikawa et al. | B41J 2/17556 |
| 9,375,938 | B2 | 6/2016 | Kondo et al. | B41J 2/17513 |
| 2002/0085074 | A1 | 7/2002 | Sanada et al. | 347/85 |
| 2004/0246304 | A1 | 12/2004 | Takahashi et al. | 347/49 |
| 2005/0007420 | A1 | 1/2005 | Ogawa et al. | 347/50 |
| 2006/0274131 | A1 | 12/2006 | Noguchi et al. | 347/85 |
| 2013/0050310 | A1 | 2/2013 | Seki et al. | 347/6 |
| 2015/0343793 | A1 | 12/2015 | Takada et al. | B41J 2/17556 |
| 2016/0200113 | A1 | 7/2016 | Nanjo et al. | B41J 2/175 |
| 2016/0200114 | A1 | 7/2016 | Nanjo et al. | B41J 2/17553 |

OTHER PUBLICATIONS

U.S. Appl. No. 15/294,442, filed Oct. 14, 2016.
U.S. Appl. No. 15/296,876, filed Oct. 18, 2016.
U.S. Appl. No. 15/272,026, filed Sep. 21, 2016.
U.S. Appl. No. 15/288,879, filed Oct. 7, 2016.
U.S. Appl. No. 15/274,806, filed Sep. 23, 2016.

* cited by examiner

LIQUID EJECTING DEVICE AND HEAD

BACKGROUND OF THE INVENTION

Field of the Invention

The present invention relates to a liquid ejecting device and a head that the liquid ejecting device has.

Description of the Related Art

As a liquid ejecting device (e.g., ink-jet printing device) for ejecting liquid such as ink to print an image or character, for example, there is one having a form in which a head having an ink tank is mounted on a carriage and a main tank for storing ink is placed at another position from the carriage. The ink in the main tank is supplied to the ink tank on the head side with a tube or the like, and the ink is ejected from an ejecting unit. As the liquid ejecting device in such a form, Japanese Patent Laid-Open No. 2000-246911 discloses a liquid ejecting device having a form in which an absorber formed of a sponge or the like is arranged inside the ink tank and a supply tube extended from a tube is inserted in the absorber.

SUMMARY OF THE INVENTION

A liquid ejecting device of the present invention includes: a liquid container that can store liquid thereinside; a head provided on a carriage and including a liquid containing unit that can store liquid thereinside, and a liquid ejecting unit that ejects liquid; and a flexible member that connects the liquid container to the liquid containing unit and supplies the liquid stored inside the liquid container to the liquid containing unit, and a holding member is arranged inside the liquid containing unit to hold the liquid stored inside the liquid containing unit, and a shortest distance between a supply port that is opened to an inside of the liquid containing unit and is an entrance of the liquid supplied from the liquid container to the inside of the liquid containing unit and a surface facing the supply port of the holding member is 0.1 mm or more and 5.0 mm or less.

Further features of the present invention will become apparent from the following description of exemplary embodiments (with reference to the attached drawings).

DESCRIPTION OF THE EMBODIMENTS

However, since in the liquid ejecting device described in Japanese Patent Laid-Open No. 2000-246911, a supply tube is inserted inside an ink tank, in the case where the ink tank is detached from the device for the purpose such as exchanging the ink tank, the supply tube needs to be detached from an absorber. In order to pull out the supply tube from the ink tank, a space is required for the device to some degree, and thus the size of the device may be increased. Further, the configuration of the supply tube is required and accordingly manufacturing costs of the device may be increased.

Hence, the present invention provides a liquid ejecting device that can efficiently supply liquid inside a liquid containing unit with a simple structure and a head.

Hereinbelow, a description is given of embodiments of the present invention with reference to the drawings.

Figure 1:
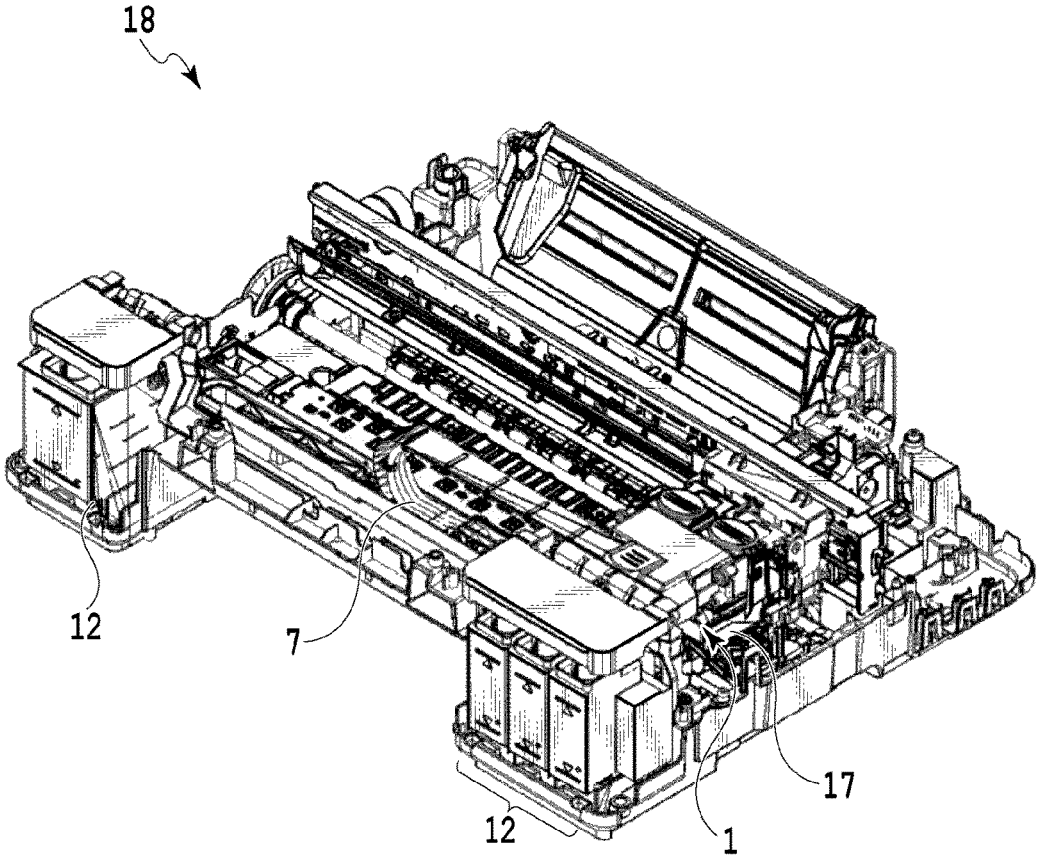
FIG. 1 is a perspective view of a liquid ejecting device.

FIG. 1 shows a perspective view of a state in which an exterior of a liquid ejecting device (inkjet printing device) 18 of the present invention is detached. A head 1 is configured capable of being mounted on a carriage 17, and is connected to a joint (not shown) provided at the top portion of the carriage 17, thereby being provided on the carriage.

The liquid ejecting device 18 is a serial-scanning type printing device, and the carriage (supporting member) 17 is movably guided in the main scanning direction with a guide shaft. The carriage 17 reciprocates in the main scanning direction with a carriage motor and a driving force transmitting mechanism such as a belt that transmits its driving force. On the carriage 17, there is mounted the head 1 including a liquid ejecting unit (ink ejecting unit) 2 that ejects liquid and a liquid containing unit (ink tank unit) 20 that supplies liquid (ink) to the liquid ejecting unit 2.

Figure 2:
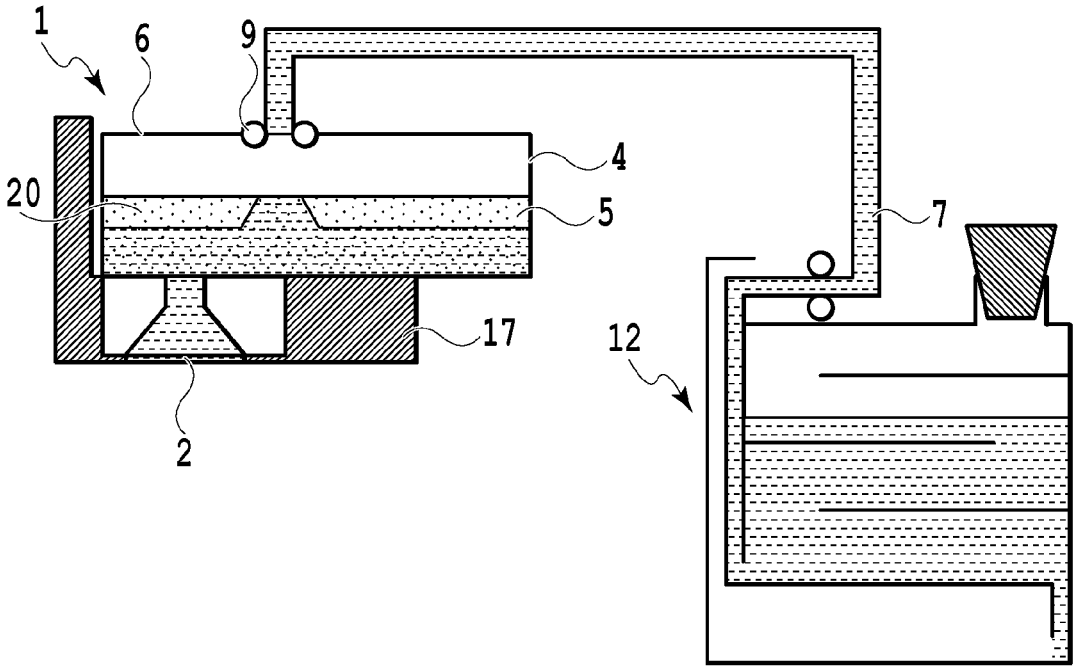
FIG. 2 is a cross-sectional view showing a liquid supply system of the liquid ejecting device of FIG. 1.

FIG. 2 is a schematic cross-sectional view of the head 1 and a liquid flow passage formed inside the head 1 in the liquid ejecting device 18 in which the head 1 of the present invention is mounted. In the liquid ejecting device 18, a liquid container (main tank) 12 that can store a relatively large amount of liquid thereinside is placed outside the carriage 17. The liquid container 12 is arranged apart from the carriage 17 at a position different from on the carriage 17. A flexible member 7 such as a tube connects the liquid container 12 to the liquid containing unit of the head 1 provided on the carriage 17.

The head 1 mounted on the carriage 17 includes a liquid ejecting unit (ink ejecting unit) 2 that ejects liquid and a liquid containing unit (ink tank unit) 20 that supplies liquid (ink) to the liquid ejecting unit 2. The liquid ejecting unit 2 is integrated to the liquid containing unit 20. As mentioned above, the carriage 17 is configured capable of supporting the head 1. The liquid containing unit 20 in the head 1 is configured capable of storing liquid thereinside. Note that the liquid containing unit and the liquid ejecting unit may not be integrated but may be formed separately from each other.

A printing medium such as a sheet is conveyed in a sub-scanning direction perpendicular to the main scanning direction of the carriage by a conveyance roller. The liquid ejecting device 18 repeats a printing operation for ejecting the liquid to a print area of the printing medium on a platen while moving the liquid ejecting unit 8 in the main scanning direction and a conveying operation for conveying the printing medium in the sub-scanning direction by a distance corresponding to a printing width thereof. Thus, images are sequentially printed (formed) on the printing medium. A plurality of ejecting ports, a plurality of pressure chambers communicating with the plurality of ejecting ports, and a plurality of flow passages communicating with the pressure chambers are respectively formed in the liquid ejecting unit 2 in the head 1. The liquid is supplied to the pressure chambers formed inside the liquid ejecting unit 2 from the liquid containing unit of the head 1 via the respective flow passages.

Each pressure chamber includes, e.g., a heat generating element (electricity/heat converter) as an energy generating element. The heat generating element is energized via a wiring, and thermal energy is generated from the heat generating element, thereby heating the liquid in the pressure chamber and generating bubbles with film boiling. Liquid droplets are ejected from the ejecting port with bubble generating energy at this time. A piezoelectric element or the like may be used as an energy generating element.

As the carriage 17 is moved in the main scanning direction, the head 1 is moved accordingly, and the liquid is ejected from the liquid ejecting unit 2. The ejected liquid lands on the printing medium or the like to perform the printing. During the printing, the liquid contained in the liquid container 12 is supplied to the liquid containing unit 20 of the head 1 via the flexible member 7. As mentioned above, the liquid in the liquid container 12 is continuously supplied to the liquid containing unit 20 of the head 1.

The liquid is directly stored in the liquid container 12. Since the amount of stored liquid is large, preferably, a holding member for holding the liquid such as a sponge may not be arranged inside the liquid container 12.

The liquid ejecting unit 2 of the head 1 is arranged at a position higher than a portion where the liquid in the liquid container 12 is stored in the gravity direction. Therefore, a water head difference is generated between the liquid ejecting unit 2 of the head 1 and the liquid container 12. With the water head difference, a negative pressure is generated inside the liquid ejecting unit 2 of the head 1. By generating the negative pressure in the liquid ejecting unit 2, it is prevented to drop the liquid from the ejecting port of the liquid ejecting unit 2 and the liquid is held inside the liquid ejecting unit 2. Note that the present invention is not limited to the configurations of the head 1 and the liquid container 12 in this system, and a system for providing a negative-pressure generating mechanism in the liquid container 12 can be applied.

Figure 3A:
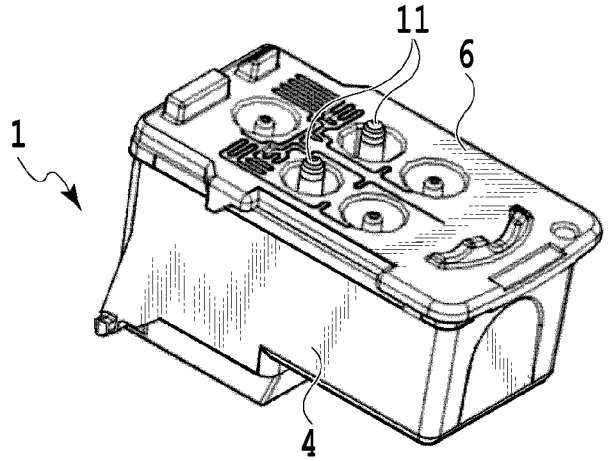
FIG. 3A is a perspective view of a head mounted in the liquid ejecting device of FIG. 1.
Figure 3B:
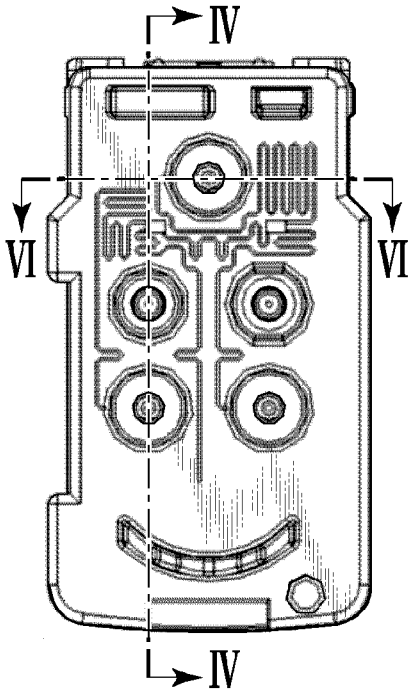
FIG. 3B is a plan view of the head.
Figure 3C:
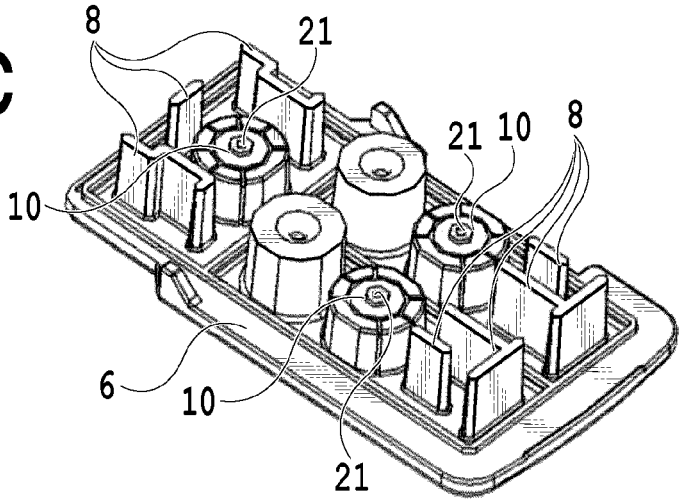
FIG. 3C is a perspective view of a cover member of the head.

FIG. 3A is a perspective view of appearance of the head 1 mounted in the liquid ejecting device. FIG. 3B is a plan view of the head 1 seen from the top surface. FIG. 3C is a perspective view showing a rear surface of a cover member 6 attached to the top surface of the head 1. On the rear surface of the cover member 6, a pressing rib 8 is provided.

Figure 4:
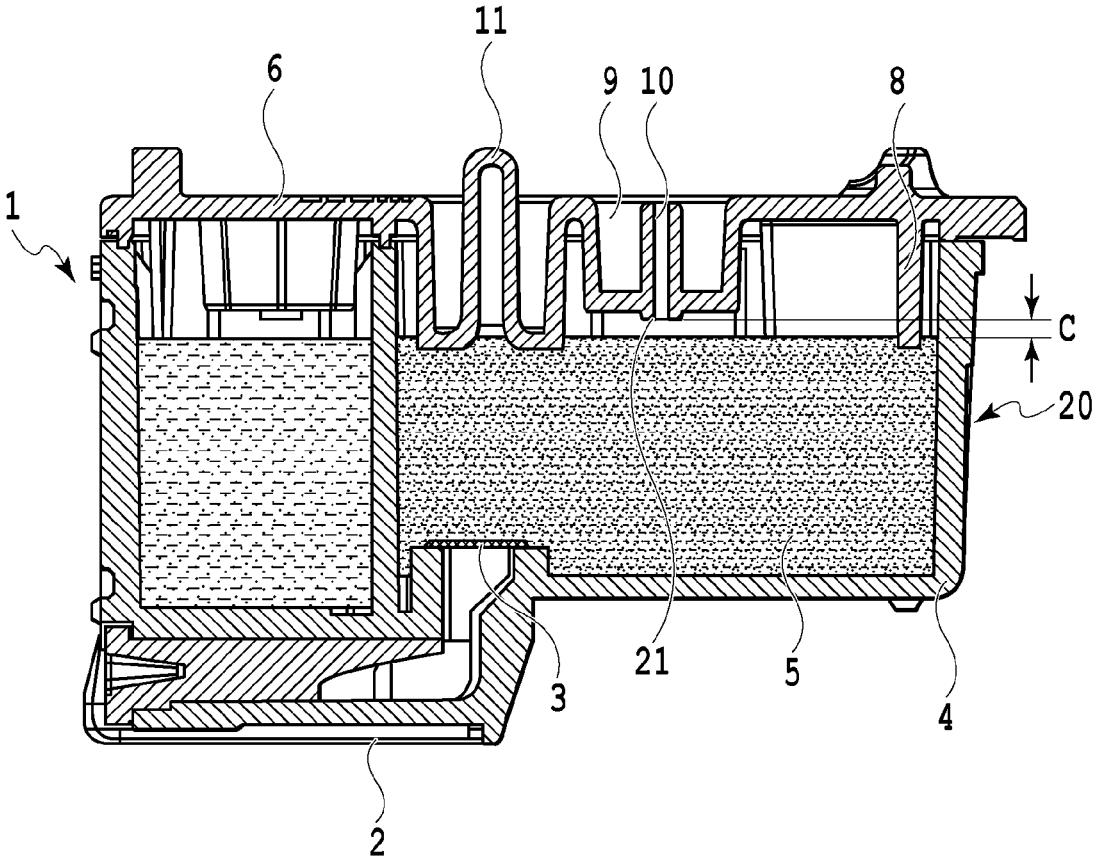
FIG. 4 is a cross-sectional view of the head in FIG. 3B along a line IV-IV.

FIG. 4 is a cross-sectional view of the head 1 along a line IV-IV in FIG. 3B. As shown in FIG. 4, the head 1 of the present embodiment includes the liquid ejecting unit 2 that ejects liquid and a filter 3 that suppresses the mix of dust to the liquid ejecting unit 2. The head 1 is formed by being surrounded with a case 4.

A holding member 5 is enclosed inside the liquid containing unit 20 to hold the liquid stored inside the liquid containing unit 20. Examples of the holding member 5 include a fiber absorber. Further, the cover member 6 is arranged on the top surface of the liquid containing unit 20. In order to supply the liquid held in the holding member 5 to the liquid ejecting unit 2, it is required to keep a state in which the holding member 5 and the filter 3 are press-contacted with each other.

Therefore, a pressing rib 8 is arranged on the rear surface of the cover member 6 to press the holding member 5 in a direction to the filter 3. Therefore, in the case where the cover member 6 is welded to the case 4 of the liquid containing unit 20 in a state in which the holding member 5 is enclosed in the liquid containing unit 20, the holding member 5 is pressed with the pressing rib 8. As a consequence, the holding member 5 and the filter 3 are press-contacted with each other.

Figure 5:
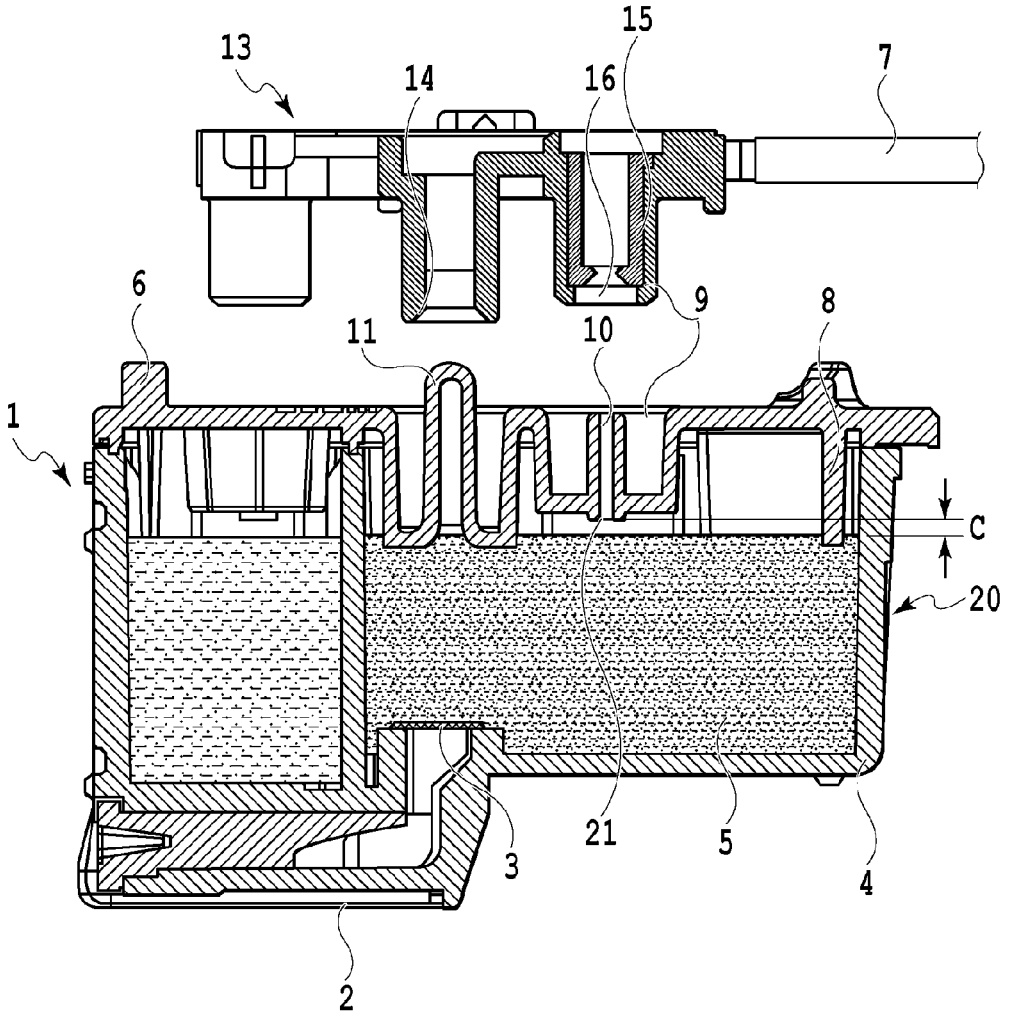
FIG. 5 is a cross-sectional view showing the head in FIG. 4 and a flow passage connecting member of a flexible member connected to the head.

FIG. 5 shows a cross-sectional view of a flow passage connecting member 13 between the flexible member 7 and the cover member 6 of the liquid containing unit 20 of the head 1. The flow passage connecting member 13 that can perform the connection to the head 1 is attached to an end of the flexible member 7 on the side of the head 1. The flexible member 7 is connected to the liquid containing unit 20 of the head 1 via the flow passage connecting member 13. A flow passage connecting unit 9 is formed on the cover member 6 to guide the liquid supplied from the flexible member 7 to inside the head 1.

A liquid supply unit 10 serving as a flow passage that can flow the liquid is formed inside the flow passage connecting unit 9. The liquid flow passage inside the flexible member 7 communicates with the inside of the liquid containing unit 20 of the head 1 via the flow passage connecting member 13 and the liquid supply unit 10. The liquid supply unit 10 communicates with the inside of the liquid containing unit 20 at a supply port 21. That is, the supply port 21 is opened to the inside of the liquid containing unit 20 and is an entrance of the liquid supplied from the liquid container 12 to the inside of the liquid containing unit 20.

The liquid supply unit 10 has a cylindrical shape projecting from the inside of the liquid containing unit 20 to the outside. The liquid supply unit 10 is not connected to the flexible member 7 during distribution of goods and is opened, and therefore the liquid may leak. The liquid is held by the holding member 5, but may move in the holding member 5 due to the posture of the head 1 or influence of air pressure, temperature, and humidity. In the case where the supply port 21 of the liquid supply unit 10 is in contact with the holding member 5, the liquid may leak to the outside along the liquid supply unit 10 after moving around the supply port 21 of the liquid supply unit 10. In order to suppress the leakage, the pressing rib 8 projecting in a direction from the rear surface of the cover member 6 to the holding member 5 is arranged on the rear surface of the cover member 6.

Since the pressing rib 8 is arranged on the rear surface of the cover member 6, in the case where the cover member 6 is attached to the liquid containing unit 20 in a state where the holding member 5 is arranged inside the liquid containing unit 20, the pressing rib 8 presses the holding member 5. The pressing rib 8 presses the holding member 5, thereby maintaining a space between the supply port 21 of the liquid supply unit 10 and the holding member 5 and maintaining the separation of the liquid supply unit 10 from the holding member 5.

Preferably, a length of an interval C at which the supply port 21 and the holding member 5 are separated from each other is 0.1 mm or more. As a consequence, a foreign matter enters between the supply port 21 and the holding member 5 and it is thus possible to suppress the connection between the supply port 21 and the holding member 5.

The cover member 6 has a projected portion 11 for positioning between the liquid containing unit 20 and the flow passage connecting member 13 on the side of the flexible member 7. An elastic member 15 is arranged in a flow passage communicating with the flexible member 7 of the flow passage connecting member 13. The elastic member 15 is has a cylindrical shape with a through-hole thereinside to surround the liquid supply unit 10. The elastic member 15 has elasticity and the liquid supply unit 10 is inserted inside the through-hole, and thereby the liquid supply unit 10 is fitted to the inside of the through-hole and held. Further, the liquid supply unit 10 on the side of the cover member 6 is inserted into the elastic member 15, thereby communicating a liquid flow passage between the flexible member 7 and the liquid containing unit 20 of the head 1. A positioning port 14 for inserting the projected portion 11 of the cover member 6 is formed on the flow passage connecting member 13. The projected portion 11 and the positioning port 14 have a projected portion on the side of the cover member 6, and such a positional relationship may be provided that the positioning port 14 exists on the flow passage connecting member 13.

Figure 6:
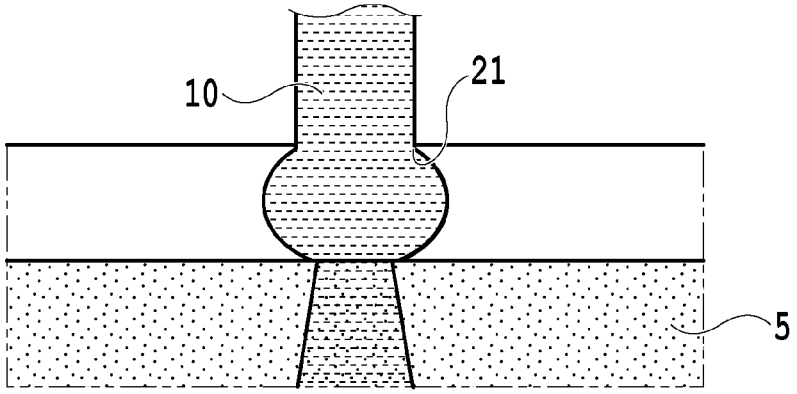
FIG. 6 is a cross-sectional view of a space between a supply port and a holding member of the head in FIG. 3B along a line VI-VI.

FIG. 6 shows a cross-sectional view along the line VI-VI in FIG. 3B. FIG. 6 is obtained by enlarging a state of supplying the liquid to the liquid containing unit 20, around the space between the supply port 21 of the liquid supply unit 10 and the holding member 5 in the head 1 of the present embodiment.

In the present invention, in the case where the liquid is supplied from the supply port 21 of the liquid supply unit 10 to the holding member 5, the liquid is in contact with the holding member 5 and is absorbed before the liquid becomes liquid droplets. At this time, as shown in FIG. 6, the liquid is supplied while connecting the supply port 21 to a surface (top surface) facing the supply port 21 of the holding member.

In the present invention, the shortest distance between the supply port 21 and the surface (top surface) facing the supply port of the holding member 5 is set to 0.1 mm or more and 5.0 mm or less. For example, in the case where there is the supply port upward in the vertical direction of the top surface of the holding member, the shortest distance is a length of a line segment vertically extended to the top surface towards the supply port from the top surface of the holding member. As mentioned above, in the present invention, the shortest distance between the supply port 21 and the top surface of the holding member 5 is reduced. More preferably, the shortest distance is set to 0.6 mm or more and 2.2 mm or less.

The interval between the supply port 21 and the top surface of the holding member 5 is narrowly formed. As a consequence, the interval between the supply port 21 and the top surface of the holding member 5 is a diameter or less of the liquid droplet in the case where the supplied liquid is liquid droplets. Therefore, in the case where the liquid is supplied to the liquid containing unit 20 from the supply port 21, the liquid becomes liquid droplets and dispersion to the outside of the supply port in the peripheral direction is suppressed. As a consequence, a range for sucking the liquid in the holding member 5 is reduced. For example, the liquid containing unit 20 may be an internal area of a circle with a diameter of 10 mm just under the supply port 21 in the liquid supply unit 10, seeing the liquid containing unit 20 from above (top side in FIG. 6).

Further, since the liquid is held in the holding member 5 before the liquid becomes the liquid droplets, the liquid is efficiently held in the holding member 5. Therefore, since the liquid is efficiently supplied to the liquid containing unit and the liquid ejecting unit from the liquid container via the tube without intermission, it is possible to suppress the deterioration in quality of the printed image. Preferably, the liquid is supplied with liquid columnar shape between the supply port 21 and the top surface of the holding member. As a consequence, the supply becomes stable.

Note that, in the case where the diameters of the liquid supply unit 10 and the supply port 21 are too small, the flow resistance of the liquid is increased. In this case, the flow resistance is high in the case where a flow rate of the liquid is high, and the negative pressure in the liquid supply unit 10 and the supply port 21 is thus increased, thereby causing an influence that the amount of liquid supply is reduced, for example. On the other hand, in the case where the diameter is too large, the liquid becomes liquid droplets at various places inside the diameter of the supply port 21. As a consequence, since the liquid lands at various places inside the liquid containing unit 20, the liquid passage to the filter 3 is interrupted, the liquid passage is not connected to the filter 3, and the liquid supply may not be stable. In consideration of these, preferably, the diameter of the supply port 21 is set to 1.0 mm or more and 1.6 mm or less.

Moreover, in the present invention, the liquid is directly supplied from the supply port 21 to the holding member 5. Thus, in the case where the liquid is supplied to the liquid containing unit, the supply tube that is inserted into the holding member 5 may not be attached. The configuration of the supply tube can be omitted and therefore the configurations of the head 1 and the liquid ejecting device 18 can be made simple. Therefore, manufacturing costs of the head 1 can be reduced and also manufacturing costs of the liquid ejecting device 18 can be reduced. Further, the supply tube that is inserted inside the holding member 5 may not be provided. In exchange of the head 1, the supply tube therefore need not be pulled out. Thus, a space required to exchange the head 1 is small. Further, the space for exchanging the head 1 need not be ensured. Therefore, the liquid ejecting device can be reduced in size.

Preferably, the liquid supply unit 10 is formed of, e.g., modified-Polyphenyleneoxide resin. Further, preferably, the holding member 5 is an absorber that absorbs the liquid, and in particular, is preferably formed of a fiber absorber. As a result, the liquid is easily absorbed to the holding member.

Preferably, the flow rate of the liquid supplied via the supply port is set to 0.1 g/min or more and 10.0 g/min or less. More preferably, the flow rate is set to 0.4 g/min or more and 6.6 g/min or less. Preferably, the surface tension of the liquid is set to 30 mN/m or more and 40 mN/m or less.

Figure 7:
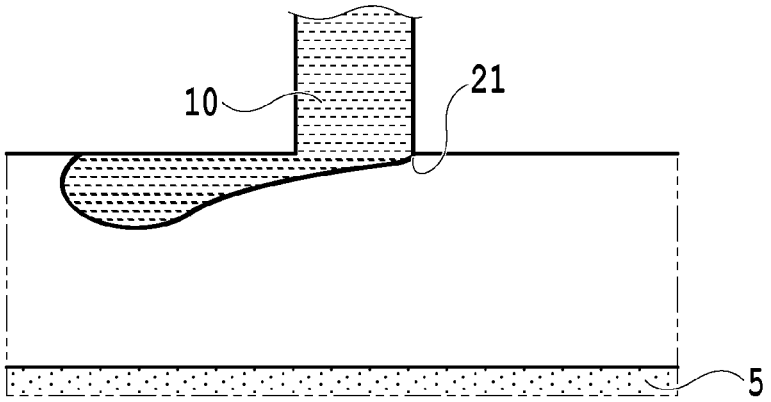
FIG. 7 is a cross-sectional view of a space between the supply port and the holding member of the head.

FIG. 7 is a cross-sectional view showing a state of supplying the liquid as a comparative example. Similarly to FIG. 6, FIG. 7 shows the enlarged view of the space between the liquid supply unit 10 and the holding member 5. In the liquid containing unit of the head shown in FIG. 7, the space between the liquid supply unit 10 and the top surface of the holding member 5 is large.

During supply of the liquid, the liquid ejecting device may perform the printing. In this case, the carriage performs scanning during the supply of the liquid inside the liquid containing unit, and inertial force is thus applied to the supplied liquid. In this case, the liquid does not flow downward in the gravity direction of the liquid supply unit 10, but moves backward of the scanning direction in the case where the carriage performs the scanning.

As shown in FIG. 7, before the liquid is supplied downward in the gravity direction, the liquid may adhere to a wall surface facing the holding member 5 in the cover member 6. As a consequence, the liquid is scattered to various places inside the head 1 and may land at various places inside the head 1. Further, since the liquid moves to the holding member 5 along the wall, the liquid passage is not connected to the filter and the liquid may not be stably supplied.

On the other hand, according to the present invention, the liquid can be stably supplied as mentioned above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-214223, filed Oct. 30, 2015, which is hereby incorporated by reference wherein in its entirety.

What is claimed is:

1. A liquid ejecting device comprising:

a liquid container constructed to store liquid thereinside;

a head provided on a carriage and including a liquid containing unit constructed to store liquid thereinside, and a liquid ejecting unit that ejects liquid; and a flexible member that connects the liquid container to the liquid containing unit and supplies the liquid stored inside the liquid container to the liquid containing unit, wherein a holding member is arranged inside the liquid containing unit to hold the liquid stored inside the liquid containing unit, wherein with respect to a supply port that is opened to an inside of the liquid containing unit and is an entrance to an inside of the liquid containing unit of the liquid supplied from the liquid container, and with respect to a surface facing the supply port of the holding member, a space is provided between the supply port and the surface facing the supply port, and wherein in the space, the liquid is supplied to the surface from the supply port without touching a side wall.

2. The liquid ejecting device according to claim 1, wherein a shortest distance of the space is 0.1 mm or more and 5.0 mm or less.

3. The liquid ejecting device according to claim 2, wherein the shortest distance of the space is 0.6 mm or more.

4. The liquid ejecting device according to claim 2, wherein the shortest distance of the space is 2.2 mm or less.

5. The liquid ejecting device according to claim 1, wherein the liquid supplied to the surface from the supply port without touching a side wall is in the form of a liquid column.

6. The liquid ejecting device according to claim 1, wherein surface tension of the liquid is 30 mN/m or more and 40 mN/m or less.

7. The liquid ejecting device according to claim 1, wherein a diameter of the supply port is 1.0 mm or more and 1.6 mm or less.

8. The liquid ejecting device according to claim 1, wherein the liquid ejecting device does not have a supply tube that is inserted into the holding member.

9. The liquid ejecting device according to claim 1, wherein the holding member is a fiber absorber.

10. The liquid ejecting device according to claim 1, wherein a flow rate of the liquid supplied via the supply port is 0.1 g/min or more and 10.0 g/min or less.

11. The liquid ejecting device according to claim 10, wherein the flow rate of the liquid supplied via the supply port is 0.4 g/min or more and 6.6 g/min or less.

12. A head including a liquid containing unit constructed to store liquid thereinside and a liquid ejecting unit that ejects liquid, wherein a holding member is arranged inside the liquid containing unit to hold the liquid stored inside the liquid containing unit, wherein with respect to a supply port that is opened to an inside of the liquid containing unit and is an entrance to an inside of the liquid containing unit of the liquid supplied from the liquid containing unit, and with respect to a surface facing the supply port of the holding member, a space is provided between the supply port and the surface facing the supply port, and wherein in the space, the liquid is supplied to the surface from the supply port without touching a side wall.

13. The head according to claim 12, wherein a shortest distance of the space is 0.1 mm or more and 5.0 mm or less.

14. The head according to claim 13, wherein a shortest distance of the space is 0.6 mm or more.

15. The head according to claim 13, wherein a shortest distance of the space is 2.2 mm or less.

16. The head according to claim 12, wherein a diameter of the supply port is 1.0 mm or more and 1.6 mm or less.

17. The head according to claim 12, wherein the holding member is a fiber absorber.

18. The head according to claim 12, wherein surface tension of the liquid is 30 mN/m or more and 40 mN/m or less.

19. The head according to claim 12, wherein the head does not have a supply tube that is inserted into the holding member.

* * * * *